United States Patent [19]

Heitfield

[11] 4,070,065

[45] Jan. 24, 1978

[54] WHEEL FOR SKATEBOARDS AND ROLLER SKATES

[76] Inventor: Vernon Heitfield, P.O. Box 722, Purcellville, Va. 33143

[21] Appl. No.: 703,676

[22] Filed: July 8, 1976

[51] Int. Cl.[2] ..... A63C 17/22

[52] U.S. Cl. ..... 301/5.3; 301/63 PW

[58] Field of Search ..... 301/5.3, 5.7, 5 R, 41 R, 301/53, 95, 63 PW, 63 R; 16/45; 152/209 R; 280/11.19

[56] References Cited

U.S. PATENT DOCUMENTS

| | | | |
|---|---|---|---|
| 2,978,277 | 4/1961 | Gaudry | 301/63 PW |
| 3,641,621 | 2/1972 | Closa | 16/45 |
| 3,895,844 | 7/1975 | Merbler | 301/63 PW |
| 3,992,025 | 11/1976 | Amelio | 301/5.7 |

*Primary Examiner*—Stanley H. Tollberg
*Assistant Examiner*—H. Grant Skaggs
*Attorney, Agent, or Firm*—Littlepage, Quaintance, Murphy, Richardson & Webner

[57] ABSTRACT

A molded plastic wheel is formed with a thin annular groove extending inwardly from its outboard end so as to provide a resiliently yieldable, radially thin peripheral tread portion backed up by a thick relatively rigid band of material on the radially inward side of the groove.

2 Claims, 3 Drawing Figures

FIG.1
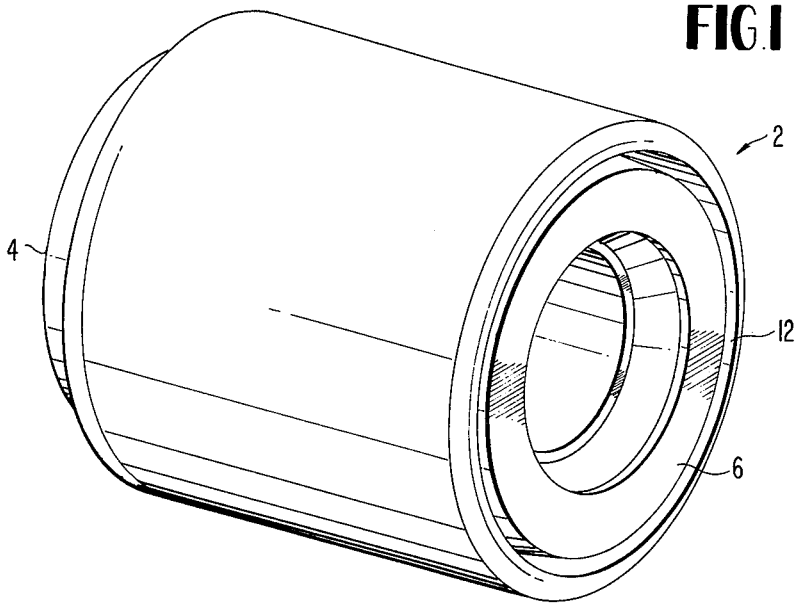
FIG.2
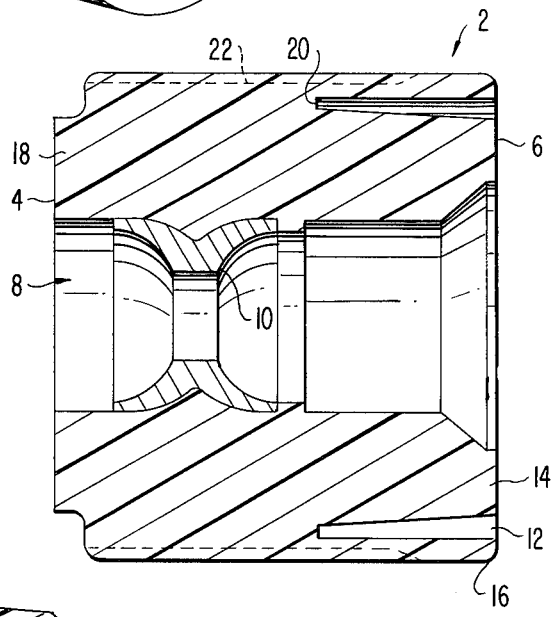
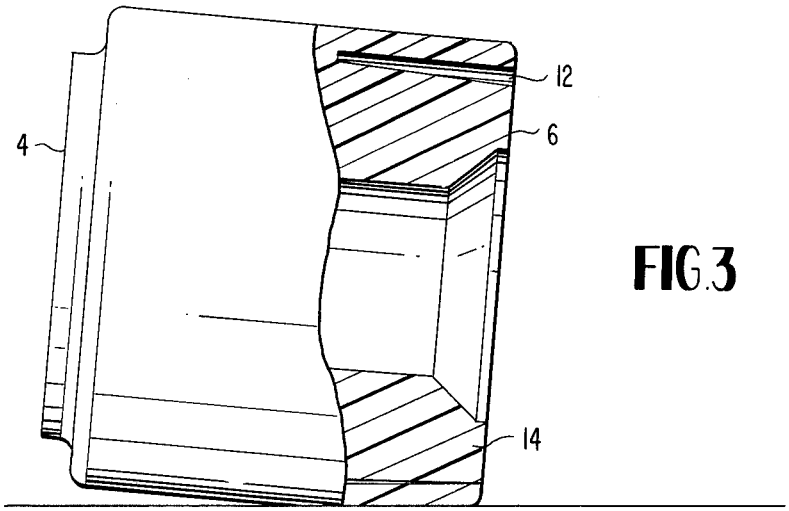
FIG.3

WHEEL FOR SKATEBOARDS AND ROLLER SKATES

FIELD OF INVENTION

Land Vehicles, Wheels and Axles, Wheels, Skates.

PRIOR ART

Gifford U.S. Pat. No. 305,915, and Uribe U.S. Pat. No. 3,311,417.

OBJECTS

Heretofore, annular recesses have been formed in one or both sides of a skate wheel, either for catching oil thrown from the wheel bearings (Gifford, supra) or to provide a cantalevered tread (Uribe, supra), but in none of these wheels is there a relatively thin, yieldable tread which is backed up by a solid, relatively stiff hub portion as in the subject invention. The object in this construction is to provide a wheel which not only partakes of the characteristics of a solid molded plastic wheel, but which greatly increases its resistance to wear while, at the same time, creating a soft wheel effect with a wheel of relatively hard plastic material.

More specifically, it is intended now to provide a molded wheel of relatively hard and stiff plastic material having in the outboard side thereof a radially thin annular groove so that the tread material of the wheel, which lies between the groove and the outer periphery of the wheel will resiliently yield and flatten out slightly, as would a solid wheel of softer material, and thereby increase the amount of tread against the ground, increase its traction, and make the wheel feel soft to the skateboarder or skater. By extending the groove only partly through the width of the wheel, the wearability of the wheel has been increased enormously, with no tendency of the tread material which lies radially outward of the groove to shear off at the end of the groove, as would be the case if the groove were either wide, deep or both.

A further feature of this invention is that the annular groove, which underlies the thin tread annulus, greatly increases the radiating surface of the wheel at the location where heat build-up is most likely to occur, and it also seems to function as a heat dissipating surface for the wheel bearings.

These and other objects will be apparent from the following specification and drawing, in which:

FIG. 1 is a perspective view of the outboard side of the wheel;

FIG. 2 is a cross-section taken centrally through the wheel; and,

FIG. 3 is a view showing the action of the wheel under load.

Referring now to the drawings in which like reference numerals denote similar elements, the wheel 2 is formed of molded polyurethane of approximately 48 durometer hardness on the Shore D scale. Wheel 2 has an inboard end 4 and an outboard end 6, that is to say the end 6 of the wheel is on the outer side when the wheels are mounted, as they usually are, in coaxial pairs on the truck of a skateboard or roller skate. Extending from end to end through the wheel is a central opening 8 in which a metal bearing flange 10 is secured. The wheel as thus far described is conventional. The inventive feature resides in an annular groove 12 which is disposed between a relatively thick and rigid hub portion 14 and a relatively thin tread annulus 16 which lies radially outward from the groove. The portion of the wheel towards the inboard end, designated 18, is solid, and the groove terminates at an inner end 20 which is preferably about three-eighths of the distance from the outboard end 6 of the wheel towards the inboard end 4. The inward extent of the groove is important in that, if it is too deep, the thin tread annulus 16 is likely to shear off when the wheel wears or is subject to successive loading, and, if the groove is too shallow, the thin tread annulus 16 will be so narrow, as measured in axially direction of the wheel, that there will be insufficient flattened load bearing surface presented to the pavement, and the wheel will partake of the characteristics of a hard, completely solid wheel, rather than of a soft wheel.

In testing the subject wheel on a test jig, after operation equivalent to 500 miles at 6.7 miles per hour, the inboard portion of the wheel periphery wore down, approximately at the location and extent indicated by the dash line. The thin tread annulus 16 showed very little wear. Solid polyurethane wheels of the same size, when tested on the same jig, under the same conditions, remained serviceable for distances equivalent only up to 25 or 30 miles. The annular groove permits a harder material to be used while nevertheless providing a good "grip" onto the road, and the harder material also rolls faster than would a soft material which yields enough to provide the same grip.

I claim:

1. A wheel of molded plastic material having inboard and outboard end portions adapted to be inwardly and outwardly disposed on a vehicle and a central cylindrical aperture extending axially from end-to-end therethrough with a bearing member therein and a cylindrical tread surface around the outer periphery of the wheel, and annular groove means extending inwardly from the outboard end of the wheel for about three-eighths of the axial length of the wheel and providing a relatively thin flexible band of material between the groove means and the tread surface which in normal use will yield and flatten out against the ground to thereby increase the amount of tread upon the ground, the material between the groove means and the central aperture underlying the entire length of the thin flexible band of material and being substantially thicker, as measured radially, than the thin flexible band of material, the material of said wheel between said tread surface and said central aperture, save for said groove means and said central aperture, being solid.

2. A wheel as claimed in claim 1, said bearing member comprising an annular flange affixed within said central aperture, said flange being disposed radially inward of that portion of the wheel material which lies between the inner end of the groove means and the inboard end of the wheel.

* * * * *